US010300716B2

(12) United States Patent
Campanini

(10) Patent No.: US 10,300,716 B2
(45) Date of Patent: May 28, 2019

(54) PRINTING APPARATUS WITH STACKING POSITION FOR OUTPUT

(71) Applicant: Custom S.P.A., Fontevivo (IT)

(72) Inventor: Alberto Campanini, Fidenza (IT)

(73) Assignee: Custom S.P.A. (IT)

( * ) Notice: Subject to any disclaimer, the term of this patent is extended or adjusted under 35 U.S.C. 154(b) by 0 days.

(21) Appl. No.: 14/645,065

(22) Filed: Mar. 11, 2015

(65) Prior Publication Data

US 2016/0243856 A1 Aug. 25, 2016

(30) Foreign Application Priority Data

Feb. 19, 2015 (IT) ..... MO2015A0034

(51) Int. Cl.

| | |
|---|---|
| ***B41J 13/10*** | (2006.01) |
| ***B65H 35/00*** | (2006.01) |
| ***B65H 35/06*** | (2006.01) |
| ***B41J 11/70*** | (2006.01) |
| ***B65H 23/00*** | (2006.01) |
| ***B65H 37/00*** | (2006.01) |
| ***B65H 31/06*** | (2006.01) |
| ***G07B 5/02*** | (2006.01) |
| ***B65H 29/46*** | (2006.01) |

(52) U.S. Cl.

CPC ..... *B41J 11/70* (2013.01); *B41J 13/106* (2013.01); *B65H 23/00* (2013.01); *B65H 29/46* (2013.01); *B65H 31/06* (2013.01); *B65H 35/00* (2013.01); *B65H 35/06* (2013.01); *B65H 37/00* (2013.01); *G07B 5/02* (2013.01); *B65H 2701/1936* (2013.01)

(58) Field of Classification Search

CPC .. B65H 35/00; B65H 2404/742; B65H 35/04; B65H 2701/1936; Y10T 83/2098; Y10T 83/2148; B41J 13/106

See application file for complete search history.

(56) References Cited

U.S. PATENT DOCUMENTS

| | | | | |
|---|---|---|---|---|
| 3,591,279 | A | 7/1971 | Gardner et al. | |
| 4,790,476 | A * | 12/1988 | Tanaka | G07D 11/0093 232/1 D |
| 6,648,325 | B1 * | 11/2003 | Mays | B65H 29/46 271/177 |
| 7,565,855 | B2 | 7/2009 | Malke et al. | |
| 7,886,888 | B1 * | 2/2011 | Chien | B65H 29/46 194/206 |
| 2001/0054342 | A1 * | 12/2001 | Kato | B26D 1/08 83/78 |

(Continued)

FOREIGN PATENT DOCUMENTS

EP 2517887 A2 10/2012

*Primary Examiner* — Jennifer E Simmons

(74) *Attorney, Agent, or Firm* — St. Onge Steward Johnston & Reens, LLC

(57) ABSTRACT

An apparatus and a printing method for lottery or betting terminals are disclosed, wherein a printed document is separated from a continuous strip of paper and then moved sideways to a document stacking zone according to a direction that is transverse to the document, which, by passing above two lateral protrusions, undergoes the folding of two lateral edges that, after passing over the protrusions, return to a normal position owing to the elasticity of the paper.

17 Claims, 10 Drawing Sheets

(56) References Cited

U.S. PATENT DOCUMENTS

| | | | | |
|---|---|---|---|---|
| 2003/0127791 | A1* | 7/2003 | Cost ..... | B65H 29/46<br>271/180 |
| 2005/0127594 | A1 | 6/2005 | Mochizuki et al. | |
| 2005/0226671 | A1 | 10/2005 | Harris et al. | |
| 2012/0272805 | A1 | 11/2012 | Kondo et al. | |

* cited by examiner

PRINTING APPARATUS WITH STACKING POSITION FOR OUTPUT

FIELD OF THE INVENTION

The invention relates to an apparatus and a printing method, in particular in which a cutting device separates a printed document from a continuous strip and in which there is a stacking zone for stacking several documents on one another.

Specifically but not exclusively, the invention can be used to form a stack or a group of documents (for example, tickets, vouchers, receipts, coupons, etc) printed on a strip (unwound from a reel) and then separated from the strip, in particular for lottery or betting terminals.

BACKGROUND OF THE INVENTION

The prior art comprises patent publication US 2005/0127594 that shows a cutting device having a movable blade that, whilst it cuts a ticket, pushes it sideways to a stacking zone above a fixed blade.

Patent publication US 2005/0226671 shows a unidirectional clutch that connects a paper-dragging roller to an oscillating rotating blade that, in the forward stroke, cuts a ticket, whereas, in the backward stroke, the roller advances the ticket to a stacking zone.

Patent publication US 2012/0272805 shows a printer in which the printed and cut document is pushed into the stacking zone by two bladed rotors arranged on the lateral edges of the document.

One of the problems of known printing apparatuses is obtaining the correct arrangement of the printed documents, placed on top of one another in an orderly manner, in the stacking zone. Another problem is to ensure the stability of the documents, which may fall from the stacking zone, especially for longer documents. It is also desirable to facilitate handling of the stack of documents, minimising the manual operations for the person removing the documents. It is also desirable to reduce the dimensions of known printing apparatuses with an automatic stacker.

SUMMARY OF THE INVENTION

One object of the invention is to make a printing apparatus that is able to remedy one or more of the aforesaid limits and drawbacks of the prior art.

One object of the invention is to disclose a printing method that is able to remedy one or more of the aforesaid limits and drawbacks.

One advantage is to provide a printing apparatus with an automatic device for stacking a plurality of printed documents.

One advantage is to form stacks of printed documents (tickets, vouchers, receipts, coupons, slips, etc) at high speed.

One advantage is to facilitate the handling of a block of documents that are printed and stacked on one another.

One advantage is to minimise the manual operations required to remove a group of printed documents from a stacking zone.

One advantage is to ensure the correct arrangement of the printed documents, placed on top of one another in an orderly manner, in the stacking zone.

One advantage is to ensure the stability of the stacked documents, which may fall from the stacking zone, especially for longer documents.

One advantage is to enable a cover to be opened that contains the stacking zone preventing the documents from falling.

One advantage is to make available a printing apparatus with an automatic stacker of relatively reduced dimensions.

One advantage is to provide a printing apparatus with an automatic stacker that is constructionally simple and cheap.

Such objects and advantages, and still others, are achieved by the apparatus and by the method according to any one of the claims set out below.

In one example, a printing apparatus comprises a cutting device, which separates a printed document from a continuous strip of paper, and a movement device, which moves the document sideways to a stacking zone according to a direction that is transverse to the document which, by passing above at least one protrusion, undergoes folding of at least one edge that, after the protrusion is passed, returns to a normal position owing to the elasticity of the paper. The return to the normal position may be promoted by a movable wall that presses the document, which has arrived at the stacked position, against the protrusion. The lateral wall can promote secure and reliable retaining of the documents in the stacked position without falling.

BRIEF DESCRIPTION OF THE DRAWINGS

The invention can be better understood and implemented with reference to the attached drawings, which illustrate one embodiment thereof by way of non-limiting example.

DETAILED DESCRIPTION OF THE INVENTION

Figure 1:
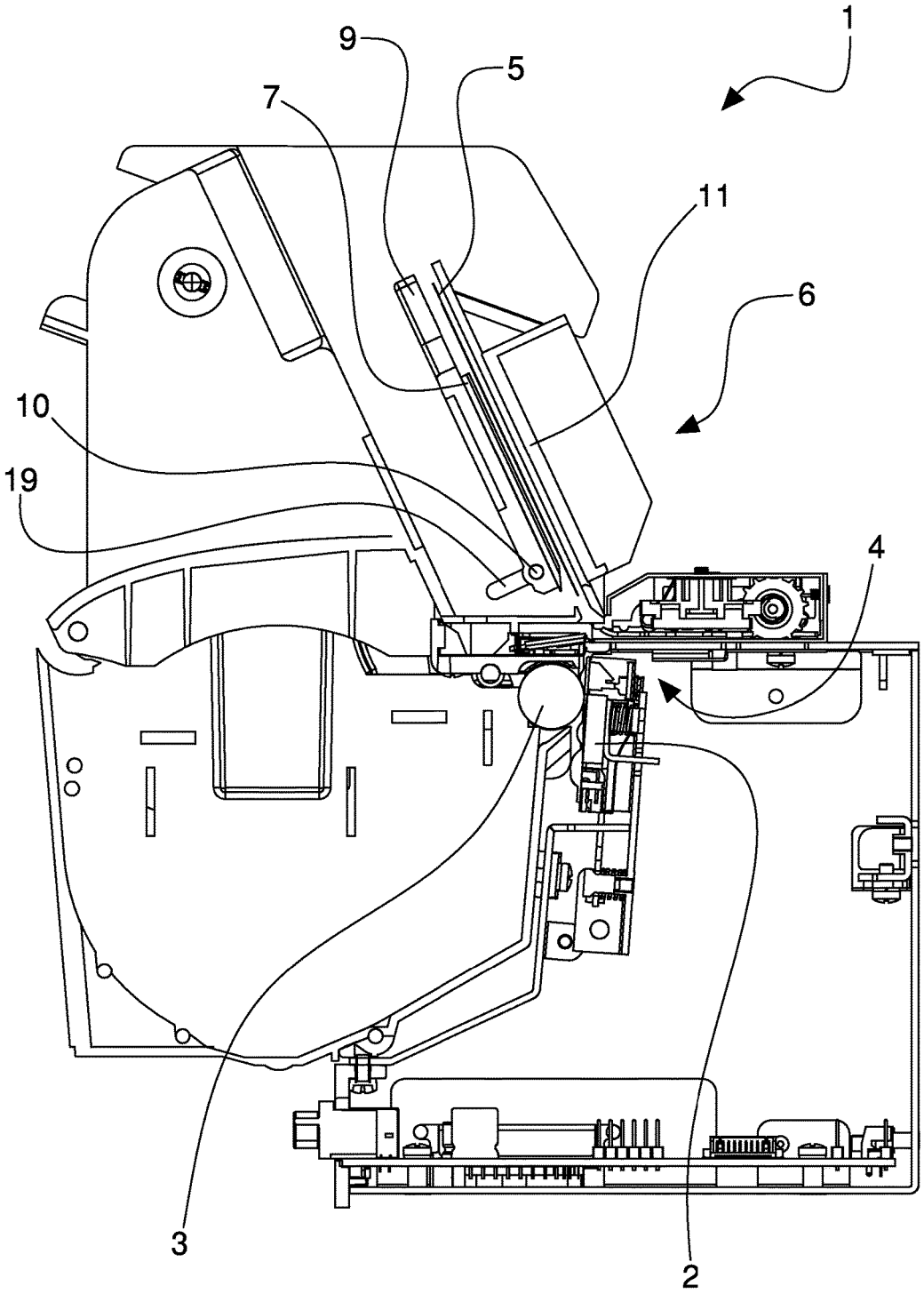
FIG. 1 is a section in a vertical elevation of one embodiment of a printing apparatus.

With reference to the aforesaid figures, overall with 1 a printing apparatus has been indicated that is usable in particular for printing tickets, vouchers, receipts, coupons, slips, or other types of printed document in real time. The printing apparatus 1 can, in particular, be used in a lottery or betting terminal.

The printing apparatus 1 comprises a magazine for housing printing paper or another type of printing support. The printing support that is usable by the printing apparatus 1 in question may be paper, for example thermal paper. In this patent document "paper" will be defined as any type of printing support that is suitable for printing (in particular with a thermal printing or inkjet printing head), for example a printable material in the shape of a strip, in particular wrapped in a reel, like a roll of (thermal) paper. In this patent document, "strip" will be defined not only as a strip of paper unwound from a reel but also as other types of printing supports (of known type), such as, for example, a set of sheets in a continuous fan-fold format, or a set of sheets (for example labels) arranged in a row on a support in the shape of a strip, etc.

In the specific case the magazine comprises at least one seat set up for receiving at least one reel of (thermal) paper. The magazine can nevertheless comprise other types of paper magazine (also of known type).

The printing apparatus 1 comprises a containing body or case, (for example box-shaped) that is suitable for containing the various components of the printing apparatus or at least a part thereof.

The printing apparatus 1 comprises a path for feeding a continuous strip of paper coming from the magazine (strip unwound from a reel) to a cutting zone of the printed document.

The printing apparatus 1 comprises a printing device for printing a document on the strip of paper that advances (unwound from the reel). The printing device comprises a (thermal) printing head 2 arranged along the path of the strip of paper for printing on at least a first side of the paper (for example a thermally sensitive side). In the specific case a thermal printing head is arranged, but it is possible to provide for the use of an inkjet printing device or still other type of printing device.

With the printing head 2 a printing roller 3 (paper-dragging roller) is operationally associated that is counterpoised to the printing head 2. The printing roller 3 operates in contact with a second side of the paper (opposite the first printable side). The route of the strip of paper passes between the printing head 2 and the printing roller 3. The printing roller 3 is controlled (by means of a programmable electronic controller) in cooperation with the printing head 2, to advance the strip in a coordinated manner during the step of printing the document.

The printing apparatus 1 comprises a cutting device 4 for separating the printed document 5 from the rest of the strip when the document 5 is (stationary) in a cutting position. The cutting device 4 comprises a movable driven blade cooperating with a stationary blade.

The printing apparatus 1 comprises a movement device 6 for moving the document sideways 5 (already separated from the rest of the strip). The document 5 is moved from the cutting position (FIG. 2), to a stacking position (FIG. 4) in which two or more printed documents can be stacked on one another to be easily grasped and/or handled by a user. "Sideways" or "lateral" movement is defined as a movement in a transverse (for example substantially perpendicular) direction to the surface of the document. In particular a "sideways" or "lateral" movement can be a movement in a direction that is transverse to the normal advancement direction of the paper if the paper were dragged by dragging rollers.

The printing apparatus 1 comprises at least a first (fixed) protrusion 7 arranged for interacting in contact with at least a first lateral edge of the document 5 (for example the right edge or the left edge) when the movement device 6 moves the document sideways from the cutting position to the stacking position. The "lateral" edge is defined as a (non-cut) edge of the document 5 that is transverse to a cut edge.

The first protrusion 7 interacts in such a manner that the first lateral edge (passing above the first protrusion 7) is folded in transit from the cutting position to the stacking position. By virtue of the elasticity of the paper, the first lateral edge can then have at least one partial elastic return when it arrives in the stacking position after passing the first protrusion 7.

The printing apparatus 1 comprises at least one second protrusion 7 (fixed, opposite the first protrusion) arranged for interacting in contact with a second lateral edge of the document (for example the left edge or the right edge), opposite the first lateral edge, when the movement device 6 moves the document sideways from the cutting position to the stacking position.

The second protrusion 7 interacts with the document in such a manner that the second lateral edge is folded in transit from the cutting position to the stacking position. By virtue of the elasticity of the paper, the second lateral edge can have at least one partial elastic return when it arrives in the stacking position after passing the second protrusion 7.

Figure 2:
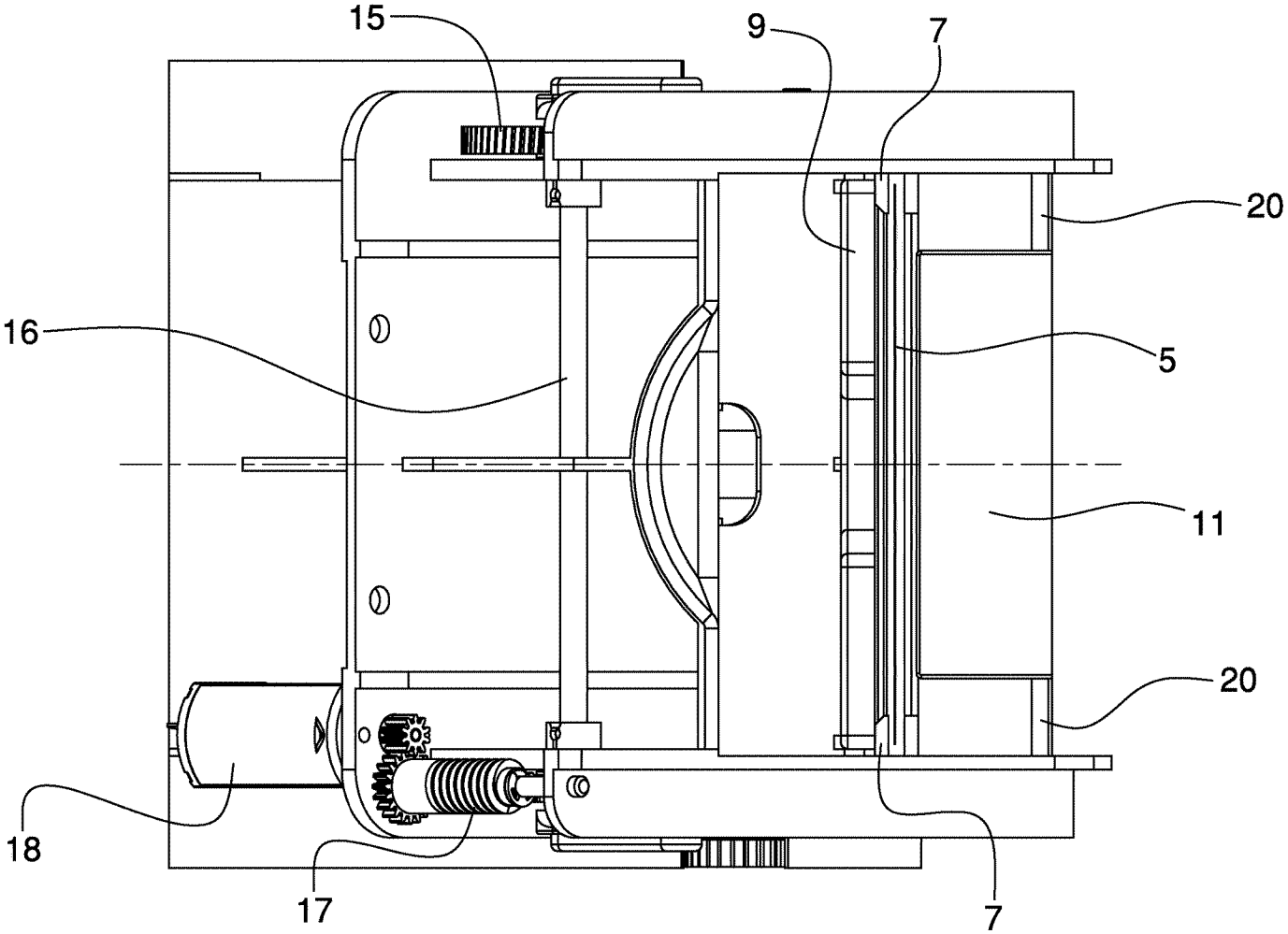
FIG. 2 is a top view of the apparatus of FIG. 1 in a first operating configuration.
Figure 3:
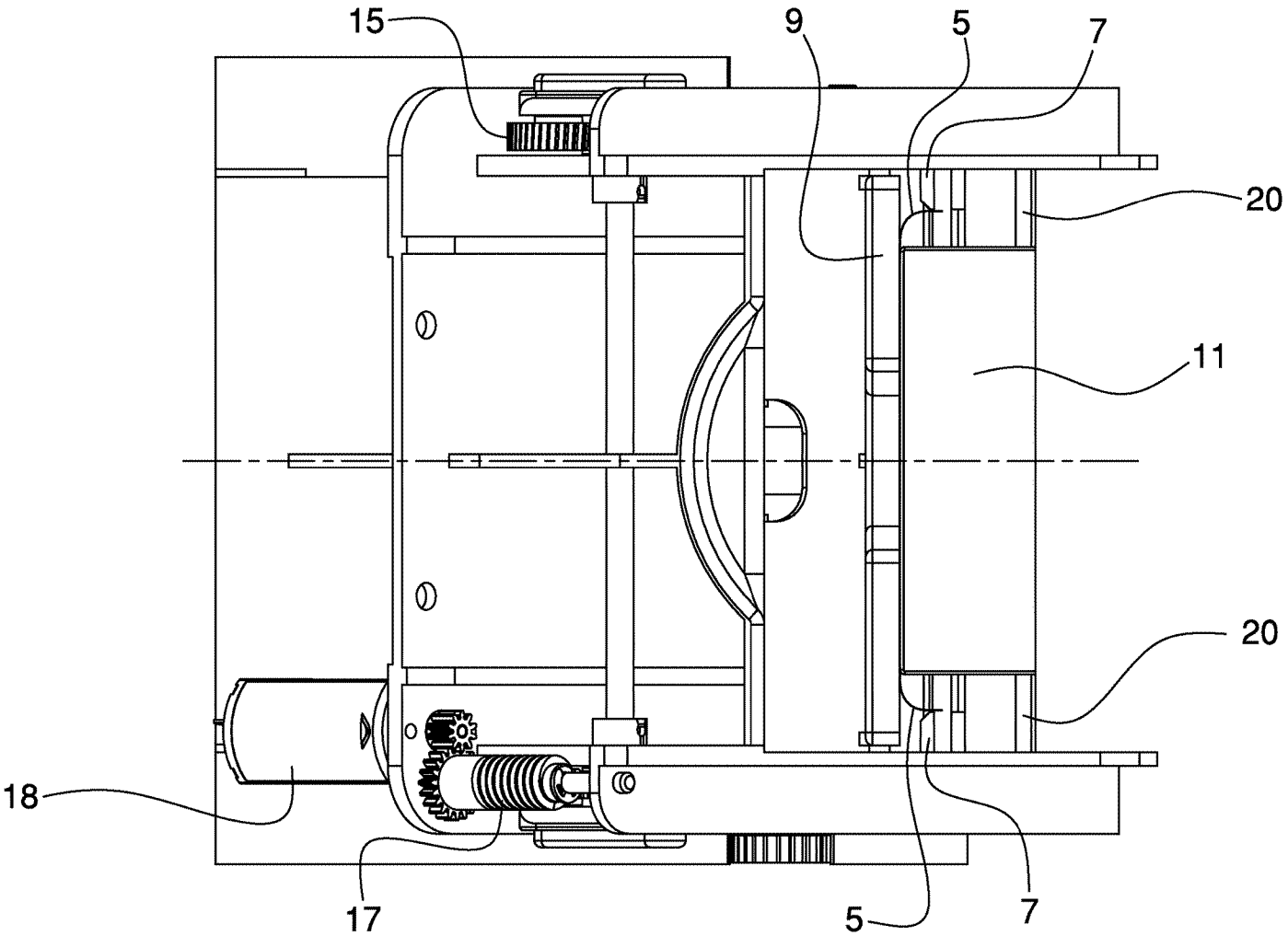
FIG. 3 is the view of FIG. 2 in a second operating configuration.
Figure 4:
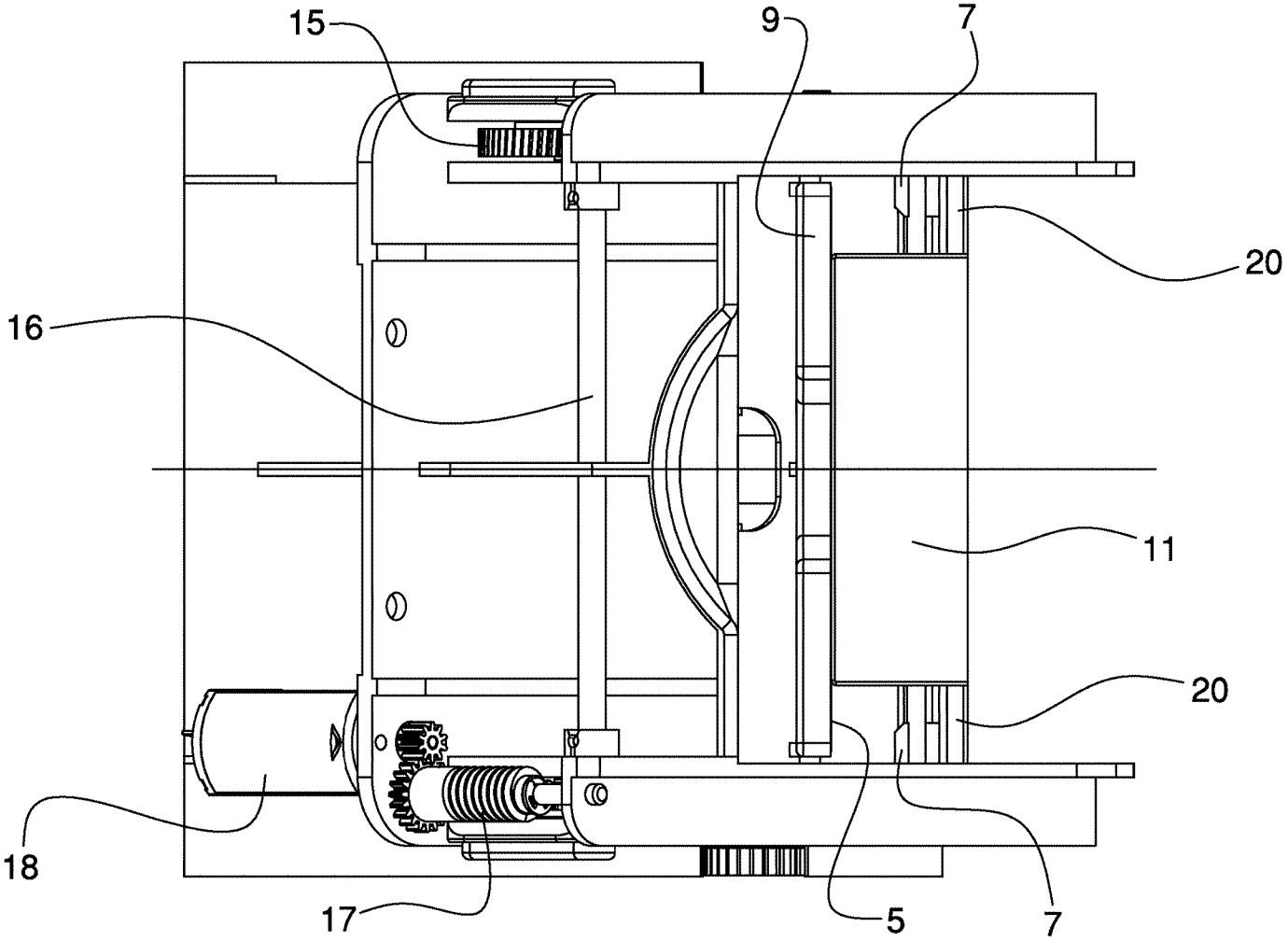
FIG. 4 is the view of FIG. 2 in a third operating configuration.

In FIGS. 2 to 4 the transit is shown of the document 5 from the cutting position (FIG. 2) to the stacking position (FIG. 4). In particular in FIG. 3 (intermediate transit position) the lateral edges of the document 5 are folded passing above the protrusions 7.

The printing apparatus 1 comprises at least one movable wall 9 that is arranged in the stacking zone to maintain the document situated in the stacking position pressed against the first protrusion 7 and/or the second protrusion 7. The stacking wall 9 is fastened (for example to the casing or to another component of the printing apparatus) by two sliding lateral pins 10 (in particular with linear sliding).

The stacking wall 9 is arranged for retracting, pushed by the movement device 6, when the latter moves the document sideways to the stacking position. The wall 9 is arranged for returning (elastically) to a suitable position for maintaining the document pressed against the protrusion/s 7 when the movement device 6 returns to the rest position ready for moving the next document sideways.

The wall 9 is provided with an elastic arrangement (for example at least one coil spring 8 arranged between the wall 9 and the casing of the apparatus) that pushes the wall 9 against the protrusion/s 7. The elastic arrangement is arranged so as to operate in contrast with the sideways movement action performed by the movement device 6.

The stacking wall 9 is wider than the free space for the transit of paper comprised between the lateral protrusions 7, i.e. the gap left free in the centre between the two protrusions 7 and through which the document 5 passes from the cutting position to the stacking position.

The elastic arrangement (spring 8) that presses on the stacking wall 9 promotes the return of the edges of the document to the normal position (not folded) when the document arrives in the stacking position after passing the protrusion/s 7. Thus the return of the edges to the non-folded position is caused not only by the elasticity of the paper but also by the pressure exerted by the resilient arrangement (spring 8) that presses the wall 9 on the document arriving at the stacking position.

The movement device 6 comprises at least one contact portion 11 arranged in contact on a side (printed previously by the printing device) of the document 5 to push the document in a direction that is transverse (perpendicular or tilted) to the document to perform the sideways movement. The contact portion 11 defines a (flat) surface that acts against a side of the document 5.

The contact portion 11 operates in a central zone of the side of the document comprised between the lateral edges thereof. The contact portion 11 comprises two or more parallel bars that are spaced apart from one another. The bars extend in length in a direction parallel or almost parallel to the document 5 located in the cutting position. The contact portion 11 comprises one or more openings. The contact portion 11 is made of plastics.

The contact portion 11 is tilted with respect to the motion direction of the portion 11 so as to promote the detachment of the document 5 from the cutting device 4 after cutting.

The movement device 6 comprises at least one movable portion 12 (bearing the aforesaid contact portion 11) having a reciprocating motion with a forward stroke (when the document 5 is moved to the stacking position) and a return stroke (so the movement device 6 can return to an ideal position for moving the next document). In particular, each movable portion 12 is slidable. Each movable portion 12 forms, substantially, a slide (with a linear sliding direction).

The movement device 6 comprises two movable portions 12 arranged parallel alongside and spaced apart from one another. The two movable portions 12 are arranged on the (right and left) sides of the document 5 that is located in the cutting position. The contact portion 11 is interposed between the two movable portions 12 and is connected (stiffly) to both the movable portions 12. The two movable portions 12 are made of plastics.

The thrust force of the contact portion 11 is perpendicular to the surface of the document 5 that is moved from the cutting position. It is possible to provide other examples in which the thrust force is tilted (for example by an angle comprised between 0° and 10°, or between 0° and 20°, or between 0° and 30°) with respect to the surface of the document 5 in the cutting position, with a tilt that is such that the thrust force has at least one component that moves the document away from the blade of the cutting device 4, so as to promote extracting of the document from the blade.

The printing apparatus 1 comprises a mechanism for transferring a rotary (unidirectional) motion to the reciprocating motion of the movable portion/s 12. The transferring mechanism comprises a link block-slider pair 13 and 14 to connect a rotating member 15 to one movable portion 12 of the movement device 6.

The link block-slider pair comprises at least one link block 13 obtained in one movable portion 12. The link block-slider pair comprises two link blocks 13 obtained in the two movable portions 12, i.e. a link block 13 for each movable portion 12.

The link block-slider pair comprises at least one slider 14 (for example in the form of a pin) arranged (eccentrically) on a rotating member 15. The link block-slider pair comprises two sliders 14 (pins) each coupled with a corresponding link block 13. The two sliders 14 are arranged on two rotating movements 15 each of which is operationally associated with a corresponding movable portion 12. The two rotating movements 15 are mounted on the same rotation axis 16. Each rotating member 15 comprises a cog.

The transferring mechanism comprises a screw feed 17 coupled (coaxially) with a rotor of an (electric, for example stepping) motor 18. The screw feed 17 is coupled with one of the two rotating movements 15 (for example by meshing).

The motor 18 drives the movement device 6 by the motion transferring mechanism, so the (unidirectional) rotation of the rotor of the motor 18 is transformed by the mechanism into the reciprocal movement of the movement device 6.

The rotation by a revolution of the rotating member/s 15 is transformed into a single step (a forward stroke and a return stroke) of the reciprocal movement of the movable portion/s 12 of the movement device 6 and of the contact portion 11 carried by the movable portion/s 12.

The stacking wall 9 has, on two opposite sides, the two pins 10 (which are integral with the wall 9) that are axially slidable between two respective slots 19. The two pins 10 are coaxial with one another, so the wall 9 can oscillate around the axis of the two pins 10. In the step of moving the document from the cutting position to the stacking position, the wall 9 is pushed by the movement device 6 performing a movement, substantially a translation movement. During this movement the pins 10 slide (in the respective slots 19).

The contact portion 11 is integrally connected to the two movable portions 12 by two respective arm portions 20. The contact portion 11, the two movable portions 12 and the two arm portions 20 are integrated into a single piece (made of plastics).

Figure 5:
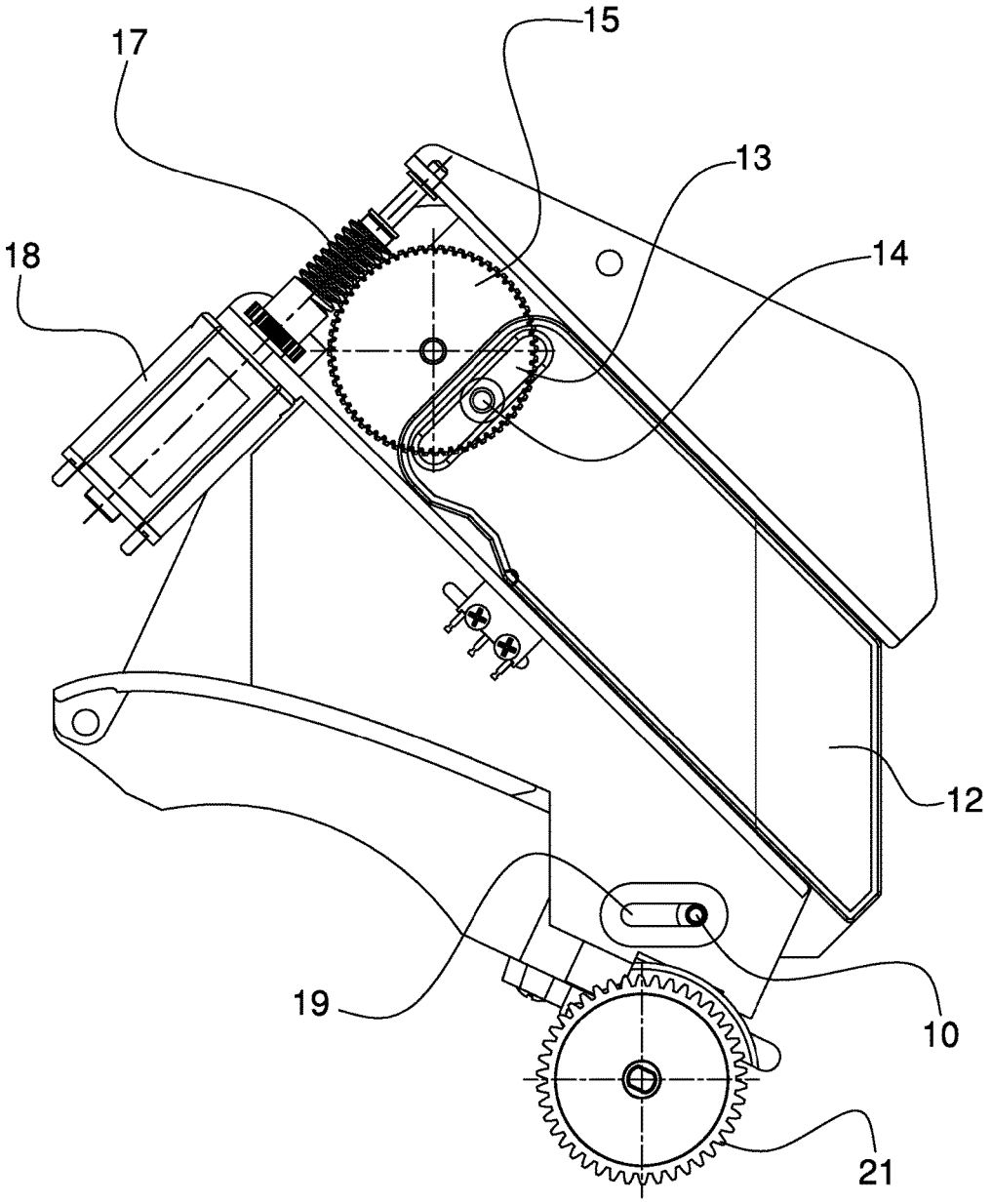
FIG. 5 is a lateral view in a vertical elevation of a detail of the apparatus in FIG. 1 in the first operating configuration.
Figure 6:
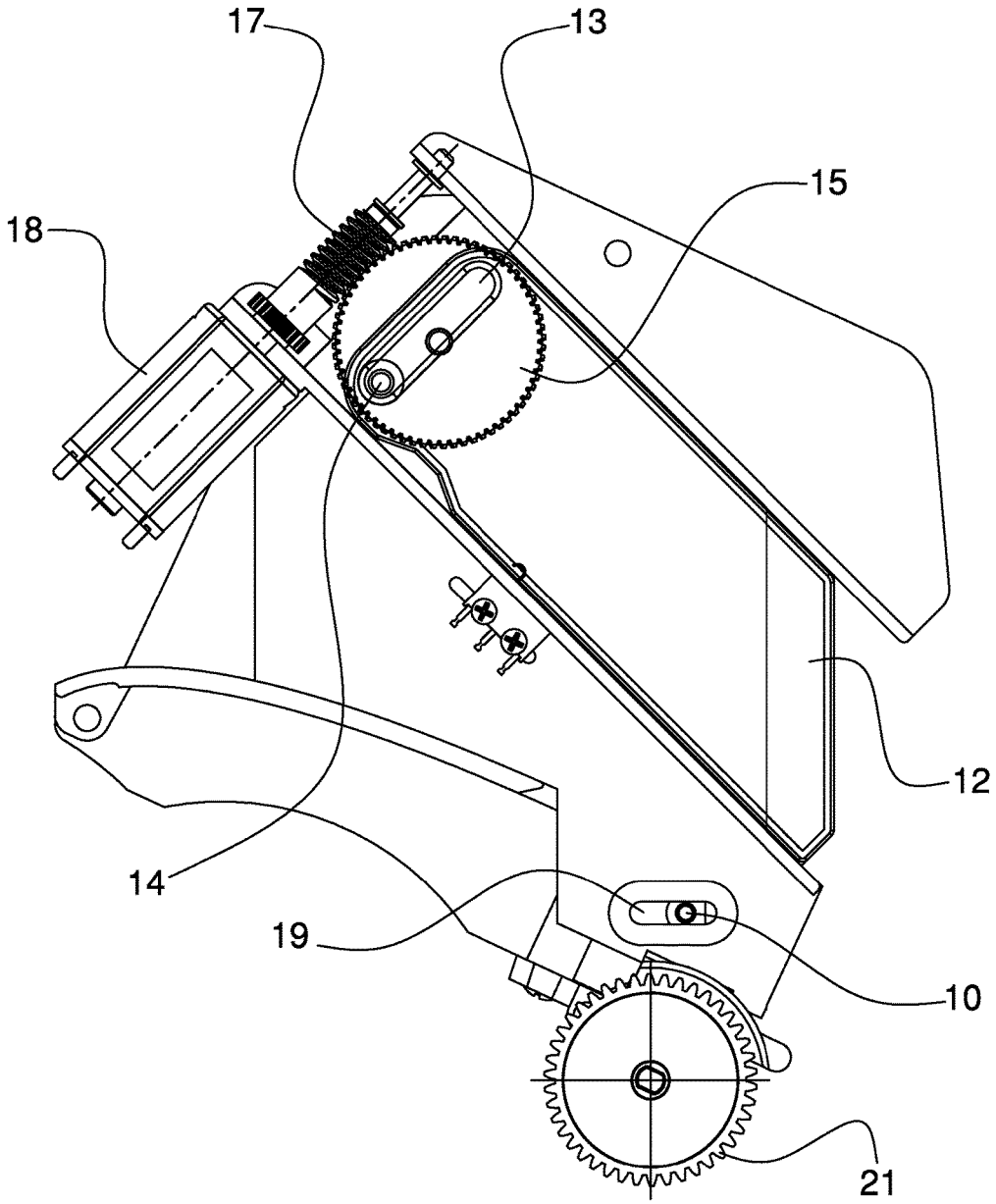
FIG. 6 is the view of FIG. 5 in the second operating configuration.
Figure 7:
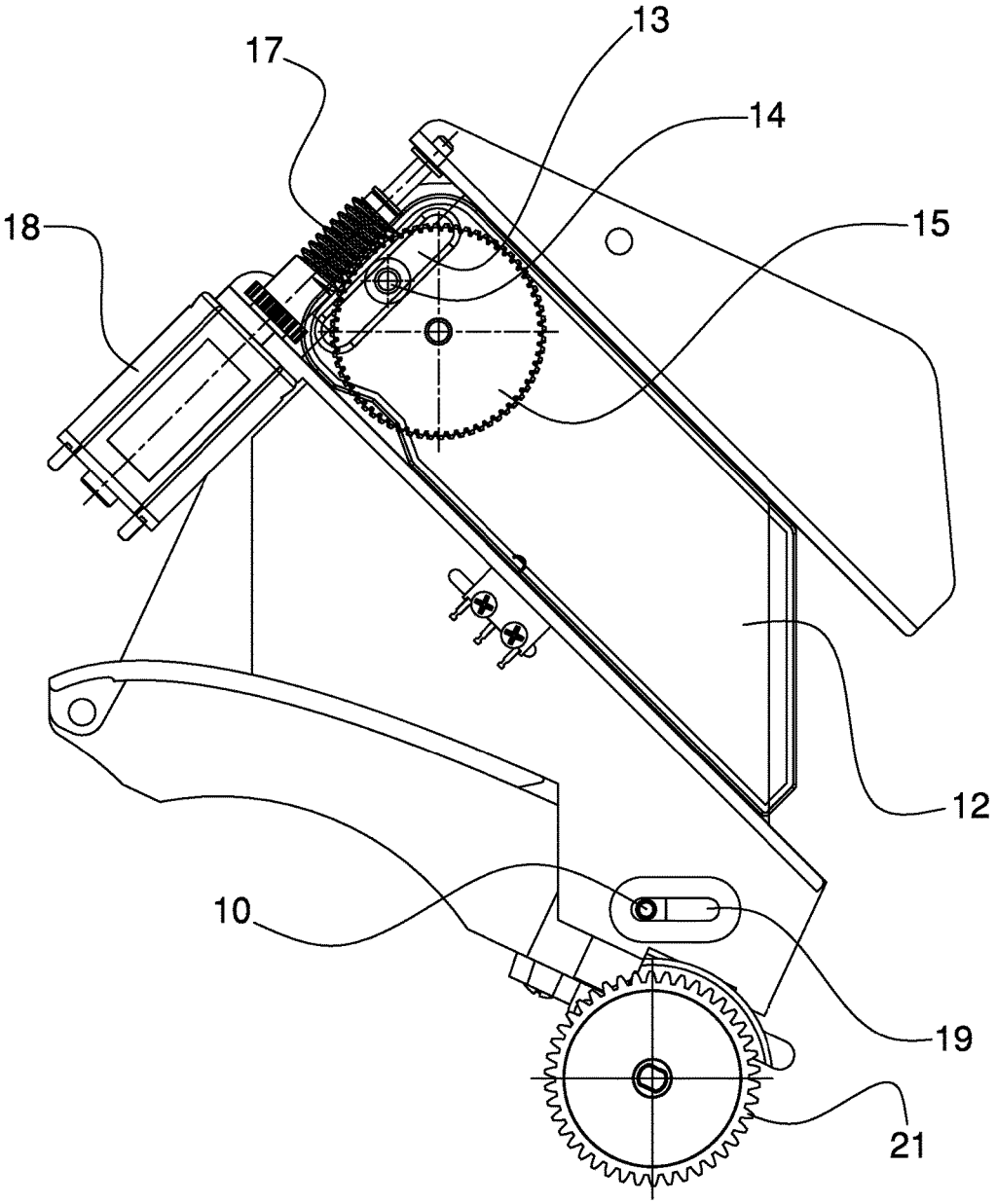
FIG. 7 is the view of FIG. 5 in the third operating configuration.

In FIGS. 5 to 7, with 21 a gear has been indicated that belongs to the drive mechanism of the printing roller 3.

Figure 8:
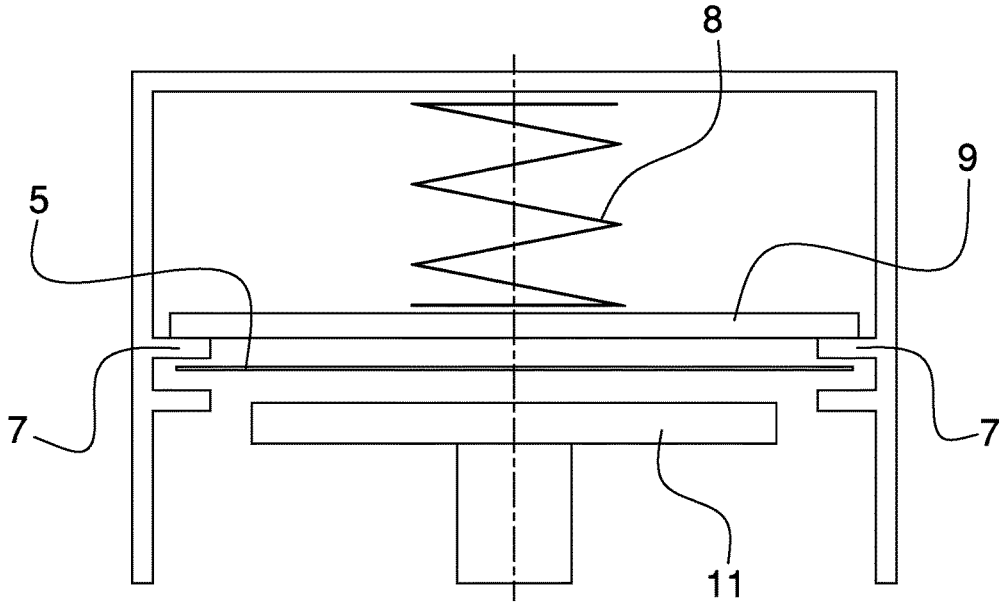
FIGS. 8 to 13 show, schematically, the operation of the apparatus in FIG. 1 in six different operating configurations.
Figure 9:
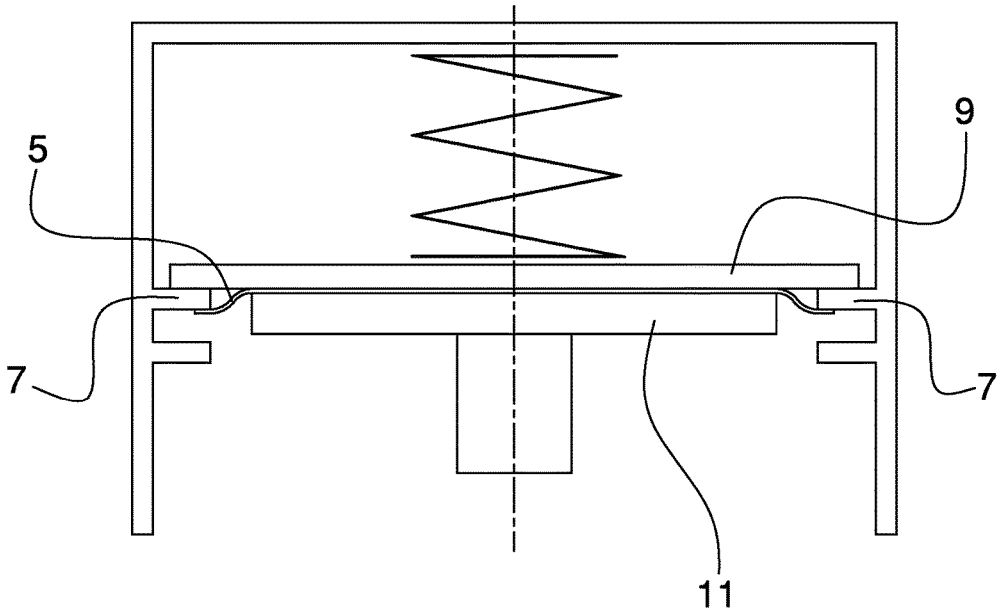

In FIGS. 8 to 13 some operating steps of the stacking arrangement disclosed above are shown schematically. In FIG. 8, a document 5 is in a cutting position, whereas the stacking zone is empty of documents. In FIG. 9, the contact portion 11 is advanced as far as the stacking wall 9 (without yet moving the stacking wall 9), whilst the lateral edges of the document 5 have started to be folded by moving over the protrusions 7.

Figure 10:
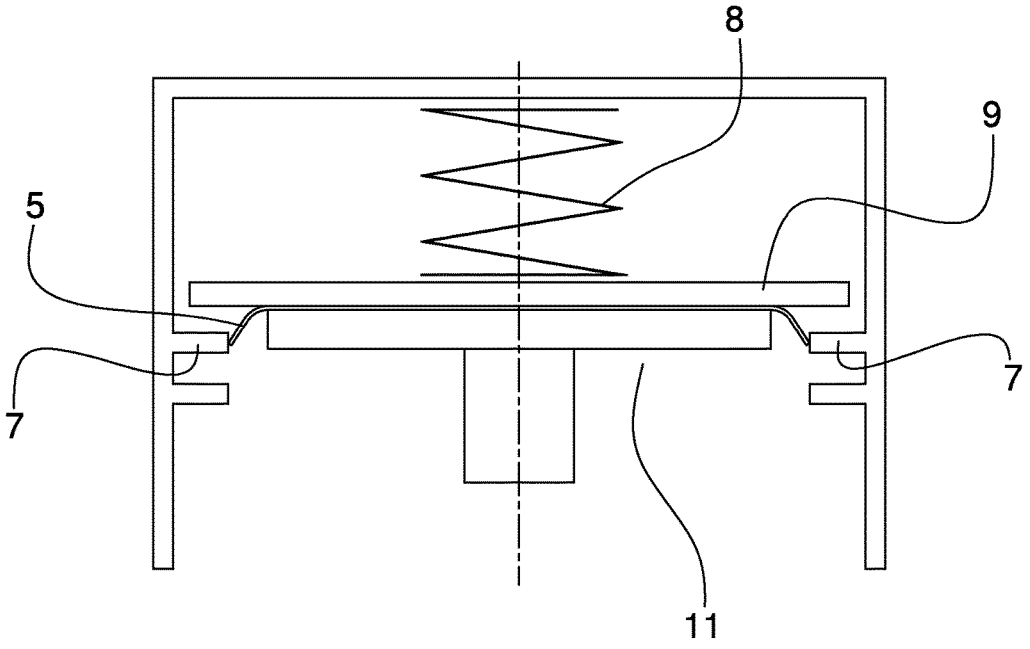
Figure 11:
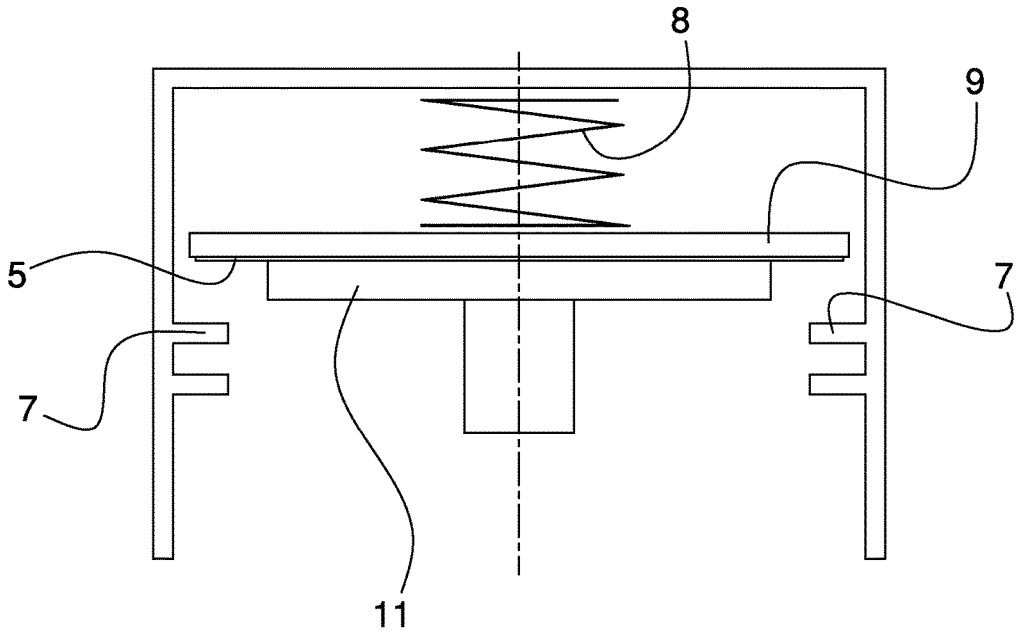

In FIG. 10, the contact portion 11 is advanced further, starting to move the stacking wall 9, whereas the lateral edges of the document 5 have continued to be folded further. In FIG. 11, the contact portion 11 is advanced still further, so the lateral edges of the document 5 have passed the protrusions 7 and are returned elastically to a non-folded position.

Figure 12:
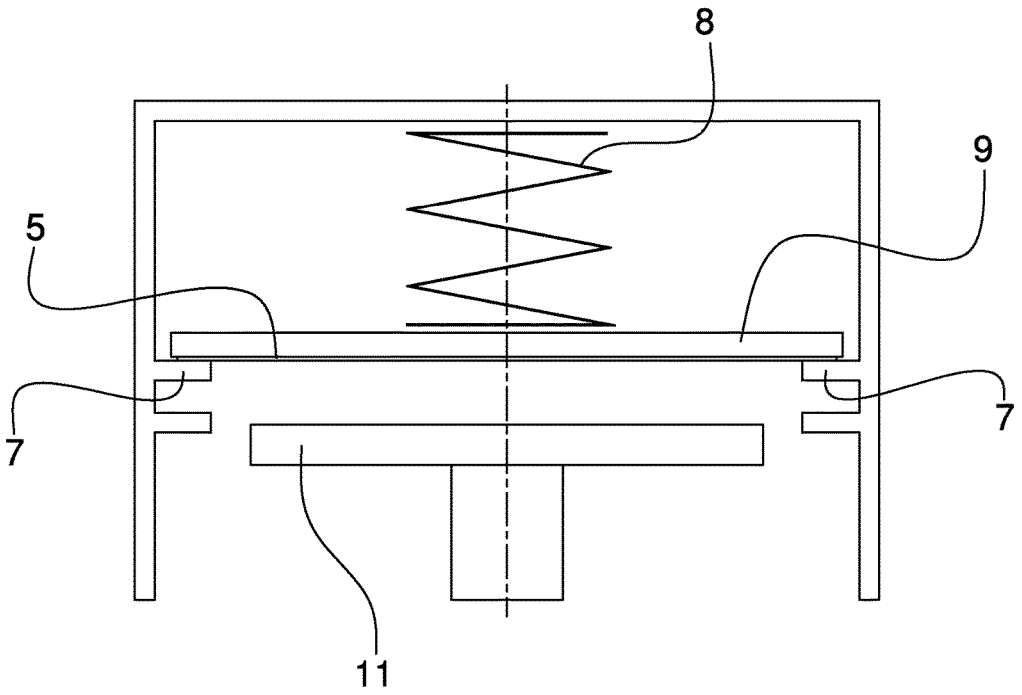
Figure 13:
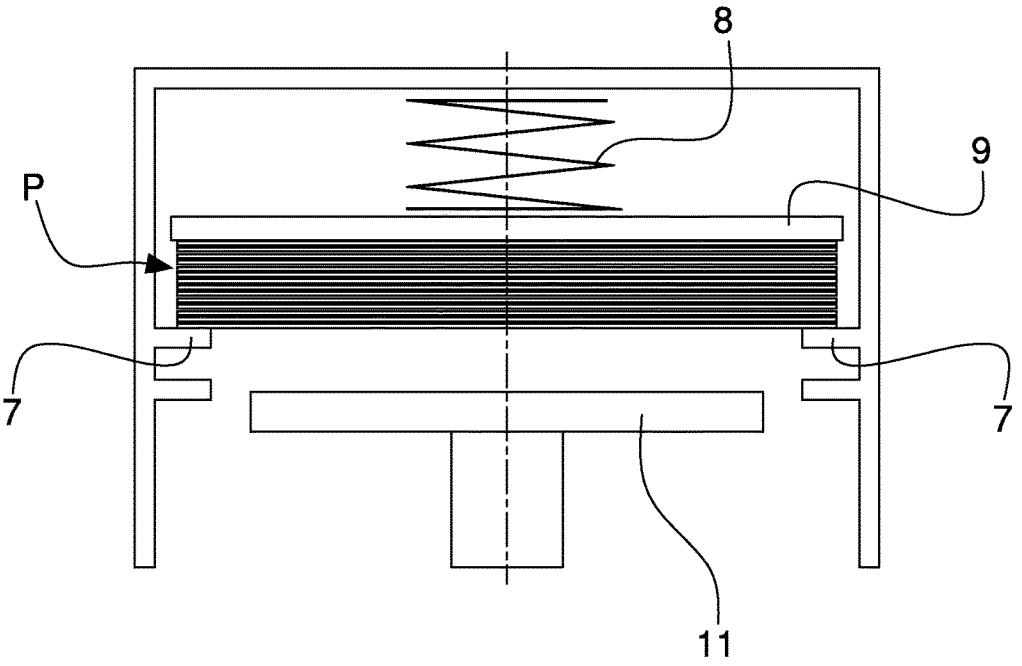

In FIG. 12, the contact portion 11 is moved back as far as the initial position of FIG. 8 and the resilient arrangement (spring 8) has moved the stacking wall 9 against the protrusions 7, so that the document 5 is retained in a stacking position between the wall 9 and the protrusions 7. In FIG. 13, the stacking arrangement has transferred (one at a time) a plurality of printed documents in a stacking position to form a stack P of documents.

The printing apparatus 1 comprises a first drive (in particular an electric motor, for example a stepping motor) for driving the movable blade of the cutting device 4. The printing apparatus 1 comprises a second drive (the motor 18) for driving the movement device 6.

In one embodiment that is not illustrated, the second drive comprises a movable element of a linear actuator. This movable element is connected (integrally) to the contact portion 11 (the movable portions 12 might no longer be present). The linear actuator can be driven electrically. The linear actuator comprises a solenoid valve or a coil. The movable element comprises the movable nucleus of the solenoid valve.

The printing apparatus 1 comprises the aforesaid programmable electronic controller (comprising for example an electronic card connected to sensors and actuators of the printing apparatus) connected to the aforesaid drives.

The controller works in such a manner that after the printing apparatus 1 has printed a document 5, the first drive separates the document 5 (located in the cutting position) from the rest of the strip. After the document 5 has been separated (with the document 5 still located in the cutting position), the second drive (motor 18) moves, for example by means of the aforesaid motion transferring mechanism, the two movable portions 12 and consequently the contact portion 11, connected to the movable portions 12, that moves the document 5 from the cutting position to the stacking position.

The printing apparatus 1 comprises a cover that contains the stacking zone. In particular, the cover includes the movable stacking wall 9 (the wall 9 can be coupled with the cover) together with the elastic arrangement (spring 8) that presses the wall 9. The cover includes the protrusions 7. The protrusions 7 are fixed to the cover. The cover is liftable. The cover is hinged on the casing of the printing apparatus 1.

The printing apparatus 1 comprises sensor indicating paper has finished (for example of known type) and an automatic cover-opening device. The controller is programmed for opening the cover automatically when the sensor detects an end of paper situation. When the cover is opened, the stacked documents that may be present remain retained in the stacking zone, owing to the wall 9 that locks the documents in position, preventing the documents from falling.

The printing apparatus 1 comprises programme instructions that are implementable on this programmable controller to run the subsequent steps of a printing method.

A first step comprises the step of printing (by means of the aforesaid printing device) the document on the advancing strip. A second step, following the first step, comprises the step of separating (by means of the aforesaid cutting device) the document from the strip. A third step, following the second step, comprises the step of moving the document to a stacking position. The step of moving involves first folding one or two lateral edges of the document (during movement) and an elastic return when they arrive at the stacking position in which they are retained in position by the stacking wall 9.

In the embodiment disclosed here, one or two opposite lateral edges of the document 5 are first folded by passing over one or two lateral protrusions 7 and then return elastically to the normal position. It is possible for the aforesaid folding to occur (additionally or alternatively) on one or two non-lateral edges, for example on one or two cut edges (front edge and rear edge) of the document. In this case the protrusions that cause the folding of the edges of the document will be arranged, instead of on the right edge and/or on the left edge of the document, on the (cut) front edge or upper edge of the document and/or on the (cut) rear edge or lower edge of the document.

The protrusions 7 define, on one side, a seat for receiving the documents in the stacking position, in which the stacked documents are separated from the document located in the cutting position. Further, the protrusions 7 define, on the opposite side, a seat for receiving a single document in the cutting position. This document, isolated and separated from the stack of documents, is processed (i.e. separated from the rest of the strip by cutting) in an appropriate manner without suffering interference from documents already transferred previously to the stacking zone.

Further, the stacking wall 9 maintains the documents locked securely in the stacking position, pressing the documents against the protrusions 7 with a force that is such as to ensure the stability of the stack P, in particular to prevent the drop by gravity (for example of a very long document), but such as to enable the stacked documents to be removed conveniently and to be handled at will. The elastic arrangement of the wall 9 is calibrated in such a manner as to exert the appropriate force. The aforesaid elastic arrangement is also be calibrated so that the wall 9 can easily retract, at least slightly, pushed by the forward stroke of the movement device 6, i.e. during the step of moving a document from the cutting position to the stacking position, to permit and ensure that the protrusions 7 are passed by the moved document.

What is claimed is:

1. A printing apparatus comprising:

a printing device for printing a document on a strip;

a cutting device for severing the document from the strip when the document is in a cutting position;

a shifting device for shifting the document laterally from said cutting position to a stacking position in which two or more printed documents can be stacked on one another;

at least one first protrusion arranged for interacting in contact with at least one first edge of the document when said shifting device shifts the document laterally from said cutting position to said stacking position such that the first edge is folded passing over said at least one first protrusion in the shift from said cutting position to said stacking position, to then have an elastic return after passing said at least one first protrusion;

at least one movable wall having a contact portion and the contact portion is arranged for maintaining the first edge of the document located in said stacking position pressed against said first protrusion;

a first motor for driving said cutting device; and a second motor for driving said shifting device;

wherein the contact portion in the stacking position is tilted with respect to a direction of movement of the shifting device.

2. The apparatus of claim 1, comprising at least one second protrusion arranged for interacting in contact with at least one second edge of the document, opposite the first edge, when said shifting device shifts the document laterally from said cutting position to said stacking position such that the second edge is folded passing over said at least one second protrusion and then has an elastic return after passing said at least one second protrusion.

3. The apparatus of claim 2, wherein said at least one movable wall being arranged for maintaining the second edge of the document located in said stacking position pressed against said second protrusion.

4. The apparatus of claim 1, wherein said movable wall is arranged for retracting thrust by said shifting device when the latter shifts the document laterally to said stacking position.

5. The apparatus of claim 4, wherein said movable wall is arranged for returning to a position suitable for maintaining the document pressed against said protrusions when said shifting device returns to a position ready to move the next document laterally.

6. The apparatus of claim 1, wherein said shifting device comprises at least one contact portion arranged in contact on a face of the document for pushing in a direction that is transverse to said face, said contact portion operating in a central zone comprised between the two opposite edges of the document.

7. The apparatus of claim 1, wherein said shifting device comprises at least one movable portion having a reciprocal motion with an outward stroke for shifting the document laterally to said stacking position and a return stroke for returning to a position that is suitable for moving the next document laterally.

8. The apparatus of claim 7, comprising a mechanism for transferring a rotational motion to the reciprocal motion of said movable portion.

9. The apparatus of claim 8, wherein said mechanism comprises a slot-slider pair to connect a rotating member to said movable portion.

10. The apparatus of claim 9, wherein said slot-slider pair comprises a slot obtained in said movable portion.

11. The apparatus of claim 9, wherein said rotating member comprises a gear and said mechanism comprises a worm screw coupled with said rotating member.

12. The apparatus of claim 1, comprising a programmable electronic controller connected to said first and second motors.

13. The apparatus of claim 1 wherein the first edge of the document is transverse to a cut edge which is cut by said cutting device.

14. The apparatus of claim 1 wherein the at least one first protrusion is maintained in contact along the first edge of the document in said stacking position.

15. The apparatus of claim 1 wherein said at least one first protrusion includes at least a first and a second protrusion, the first protrusion and second protrusion arranged to respectively contact along first and second edges of the document when the document is in said stacking position.

16. The apparatus of claim 15 wherein said first and second edges of the document are transverse to a cut edge which is cut by said cutting device.

17. The apparatus of claim 1 wherein in said stacking position, the two or more printed documents are accessible to be grasped and/or handled by a user; and wherein said movable wall maintains the two or more printed documents in a stack of documents locked securely in said stacking position pressing the stack of documents against said first protrusion with a force that such as to ensure stability of the stack of documents to prevent drop by gravity but to enable one or more of the printed documents to be removed.

* * * * *